US005470018A

United States Patent [19]

Smith

[11] Patent Number: 5,470,018

[45] Date of Patent: Nov. 28, 1995

[54] THERMOSTATICALLY CONTROLLED GAS HEATER

[75] Inventor: Ronald G. Smith, Bowling Green, Ky.

[73] Assignee: DESA International, Inc., Bowling Green, Ky.

[21] Appl. No.: 367,680

[22] Filed: Dec. 30, 1994

Related U.S. Application Data

[63] Continuation of Ser. No. 111,219, Aug. 24, 1993, abandoned.

[51] Int. Cl.[6] ..... F23Q 9/08; F24H 3/00

[52] U.S. Cl. ..... 236/15 A; 126/116 A; 431/280

[58] Field of Search ..... 431/280, 281; 236/15 A, 1 EB; 126/116 A

[56] References Cited

U.S. PATENT DOCUMENTS

| | | | |
|---|---|---|---|
| 1,836,567 | 12/1931 | Wolpert et al. | 126/116 A |
| 1,874,971 | 8/1932 | Hall et al. | 236/1 EB |
| 2,051,401 | 8/1936 | Winterstein | 236/15 A |
| 2,121,977 | 6/1938 | Newell | 236/15 A |
| 2,139,344 | 12/1938 | Andersen | 236/1 EB |
| 2,308,275 | 1/1943 | Gauger | 236/1 EB |
| 2,383,641 | 8/1945 | Focke et al. | 236/1 EB |
| 2,387,792 | 10/1945 | Holmes | 236/1 EB |
| 2,488,388 | 11/1949 | Evans | 236/15 A |
| 2,917,239 | 12/1959 | Matthews | 236/1 EB |
| 5,295,820 | 3/1994 | Bilcik et al. | 431/281.1 |

*Primary Examiner*—William E. Wayner
*Attorney, Agent, or Firm*—Jones, Day, Reavis & Pogue

[57] ABSTRACT

A thermostatic gas heater which permits the user to mechanically select the number of active heating elements, ranging from one to the total number of heating elements. The thermostat mechanically regulates gas flow to all active heating elements. No electricity is necessary for operation because all control components operate mechanically.

7 Claims, 7 Drawing Sheets

THERMOSTATICALLY CONTROLLED GAS HEATER

This is a continuation of application Ser. No. 08/111,219, filed on Aug. 24, 1993, now abandoned.

This invention relates generally to thermostatically controlled unvented gas heaters, and more particularly to the means for controlling the heating elements in the thermostatic mode of operation.

BACKGROUND OF THE INVENTION

Gas heaters of the type here under consideration have a plurality of individual heating elements which are often in the form of ceramic plaques. A gaseous fuel and air mixture burns on the surface of the plaques, which in turn radiate the heat. The gaseous fuel supply may be either natural gas or propane gas.

One form of prior art heater is the VANGUARD heater manufactured by DESA International, Inc., 2701 Industrial Drive, Bowling Green, Ky. 42102, the assignee of the present application. A schematic representation of this heater is shown in FIG. 1A.

Referring now to FIG. 1A, a gas supply, either natural gas or propane, is delivered to a main regulator 10. The gas then passes through a conduit 12 to an infrared burner control valve 14, which is operated by a selection knob 15. The knob is movable between "off," "pilot," "low," "thermostat" and "high" positions.

A thermostat switch 16, which is energized from a power supply 18 (normally 120 volts, 60 Hertz), operates a solenoid valve 20 through a circuit board assembly 22.

The VANGUARD heater includes five infrared burners or plaques labeled A through E. Plaques C and D receive their gas supply through a conduit 24 in communication with the control valve 14; these two plaques are on all the time the heater is heating. When the selection knob 15 is in the "off" or "pilot" position, no burners are active. When selection knob 15 is in the "thermostat" position, the flow of gas supplied to plaques A, B and E through conduit 19 is controlled by the solenoid valve 20, which depends on the setting of the thermostat switch 16. When the selection knob 15 is in the "high" position, a conduit 17 bypasses the solenoid valve 20 and supplies fuel to plaques A, B and E.

In the thermostatic mode of operation, the knob 15 is moved to the "thermostat" position, and the thermostat switch 16 is rotated to a desired setting, anywhere between "high" and "low" positions. If more heat is required to achieve a temperature commensurate with the thermostat setting, combustion occurs on all five plaques. Once the thermostat is satisfied, the heater modulates to the two plaques C and D. When the room cools down, the thermostat again calls for heat and combustion occurs on all five plaques.

It is apparent that the VANGUARD heater is somewhat limited in that modulation can occur only between all plaques and two plaques. Furthermore, electricity is required of the solenoid 20 while in the thermostat mode. Thus, in the event of a power outage, the heater cannot operate in the "thermostat" mode, but can be operated only in either "low" or "high" positions. In the "low" mode, only burners C and D will operate. In the "high" position, all five plaques will operate.

Another form of heater is a TB model, gas-fire, infrared room heater, sold by Rinnai America Corporation, 1662 Forest Avenue, LaGrange, Ga. 30240. A schematic of that heater is shown in FIG. 1B.

The RINNAI heater works similar to the VANGUARD heater but with two plaques, A and B, instead of five. A fuel supply of either natural gas or propane gas is delivered to an infrared burner control valve and main regulator 30.

An infrared burner selection knob 32 is movable to positions "off," "pilot," "low" and "high." While in the "off" or "pilot" position, neither burner is active. While selection knob 32 is in the "low" position, the control valve 30 continuously fuels burner A through conduit 31. When the knob 32 is moved to "high," both burner A and B are active, but burner B is thermostatically controlled by electrical power.

A main switch 36 governs the power supply 38 (normally 120 volts and 60 Hertz) to the whole system. The power supply 38 energizes a thermostat switch 40, a warm air circulating blower 42 and a rectifier 44, which converts the alternating current to direct current for purposes of powering the solenoid 46.

In the thermostatic mode of operation, the knob 32 is moved to the "high" position and the thermostatic switch 40 is rotated to a desired temperature setting, anywhere between "high" and "low" positions. The thermostat switch 40 via rectifier 44 controls the solenoid valve 46 to regulate the flow of gas supplied to burner B through conduit 48. Gas is supplied to burner B when more heating is required to achieve a temperature commensurate with the setting of the thermostat switch 40. The gas to burner A is unregulated and continues flowing regardless of the setting on the thermostat switch 40.

The RINNAI heater has limitations similar to the VANGUARD heater. Modulation can only occur between 1 and 2 burners. Because the RINNAI heater is electrically powered, it is also affected by a power outage. In the event of a power outage, the heater would operate at only the "low" position; control of burner B by thermostat switch 40 would not be possible.

Furthermore, when available, electricity provides a possible hazard. The electrical source provides a potential ignition source in the event that damage to the heater or a malfunction causes a gas leak.

SUMMARY OF THE INVENTION

The present invention overcomes these limitations. No electricity is needed to operate the heater. A thermostat mechanically regulates the flow of gas to the burner control valve. Additionally, a manual control knob controls the burner control valve that distributes gas to the selected number of plaques that are active during heating. Hence, the heater is not dependent on the vagaries or hazards of electrical supplies.

In the thermostatic mode, the number of active plaques modulates between the pilot mode, and one, two, three or all plaques, depending on the number of plaques selected by the manual control knob. When the thermostat calls for more heat, all of the selected plaques burn, and the quantity of gas regulated by the thermostat is equivalently apportioned to each of the active plaques. Because the number of active plaques are adjustable, the heater of the present invention is adaptable to rooms of various sizes and heat requirements.

One object of this invention is to provide a heater which is not subject to the vagaries or hazards of electrical power.

Another object of this invention is to provide a heater which can modulate heating between pilot and one, two, three or all of the heating elements.

A further object of this invention is to provide a heater which equally regulates the amount of gas supplied to all the active heating elements, regardless of the number of elements that are active.

An even further object of this invention is to provide a heater which is easily adaptable to rooms of different sizes and heat requirements.

A still further object of this invention is the provision of improved means for igniting the gas in the vicinity of the heating elements.

The present invention is more fully described in the Description of the Preferred Embodiment with reference to the Drawings.

BRIEF DESCRIPTION OF THE DRAWINGS

The illustrations of the present invention include the following.

DESCRIPTION OF THE PREFERRED EMBODIMENT

Figure 1A:
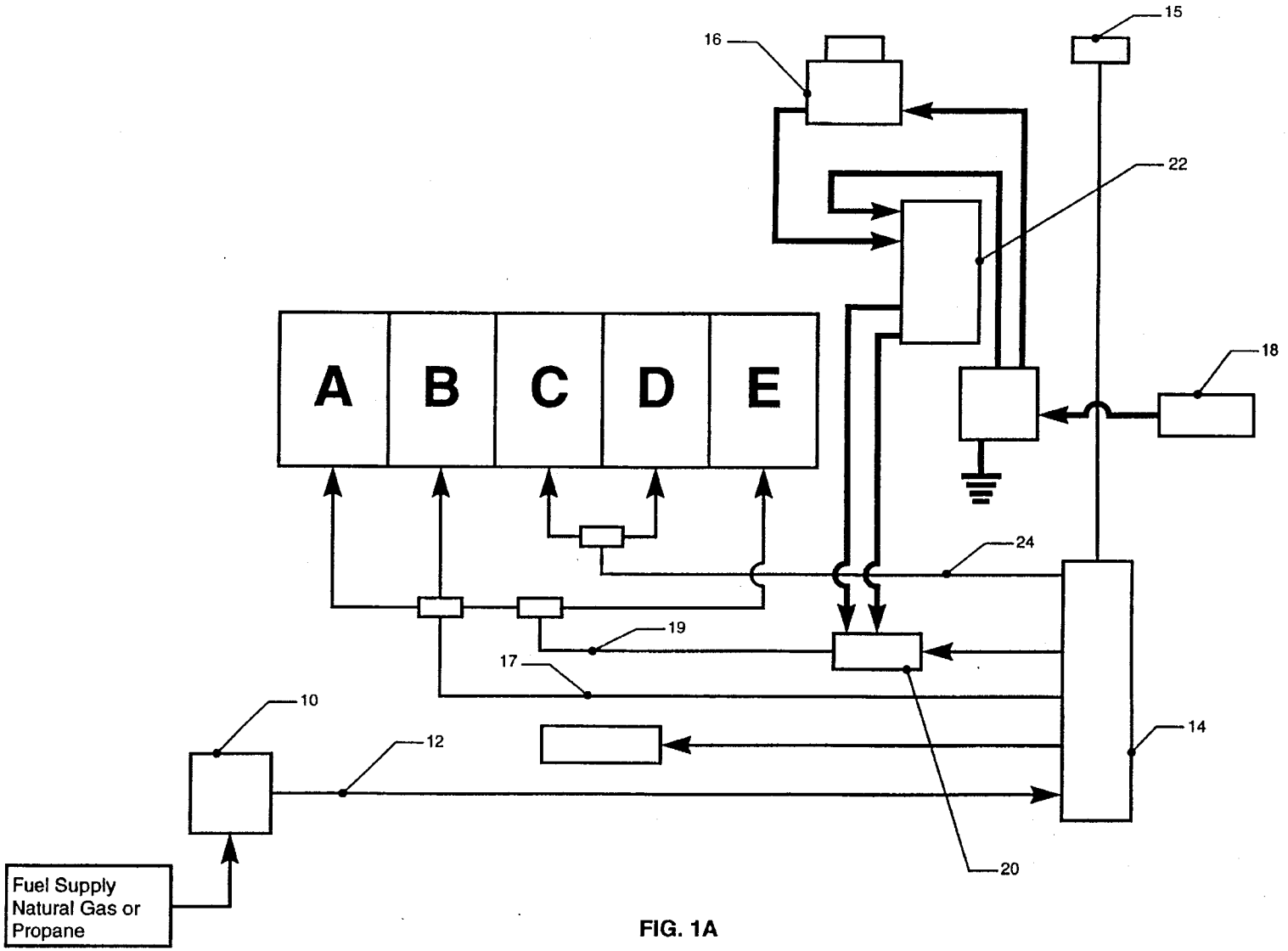
FIG. 1A is a schematic of the prior art DESA VANGUARD Thermostat Plaque Gas Heater.
Figure 1B:
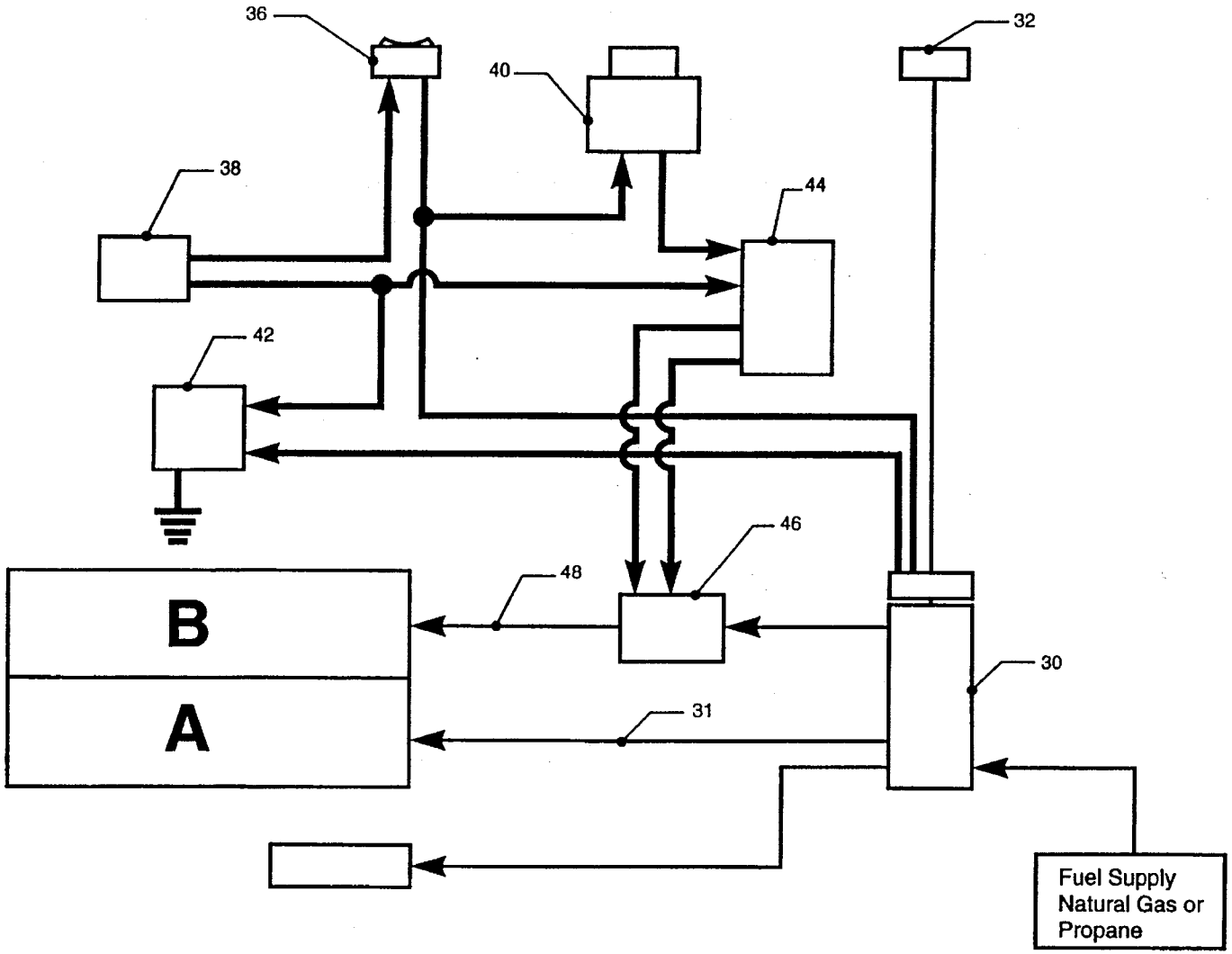
FIG. 1B is a schematic of the prior art RINNAI Thermostat Plaque Gas Heater.
Figure 2:
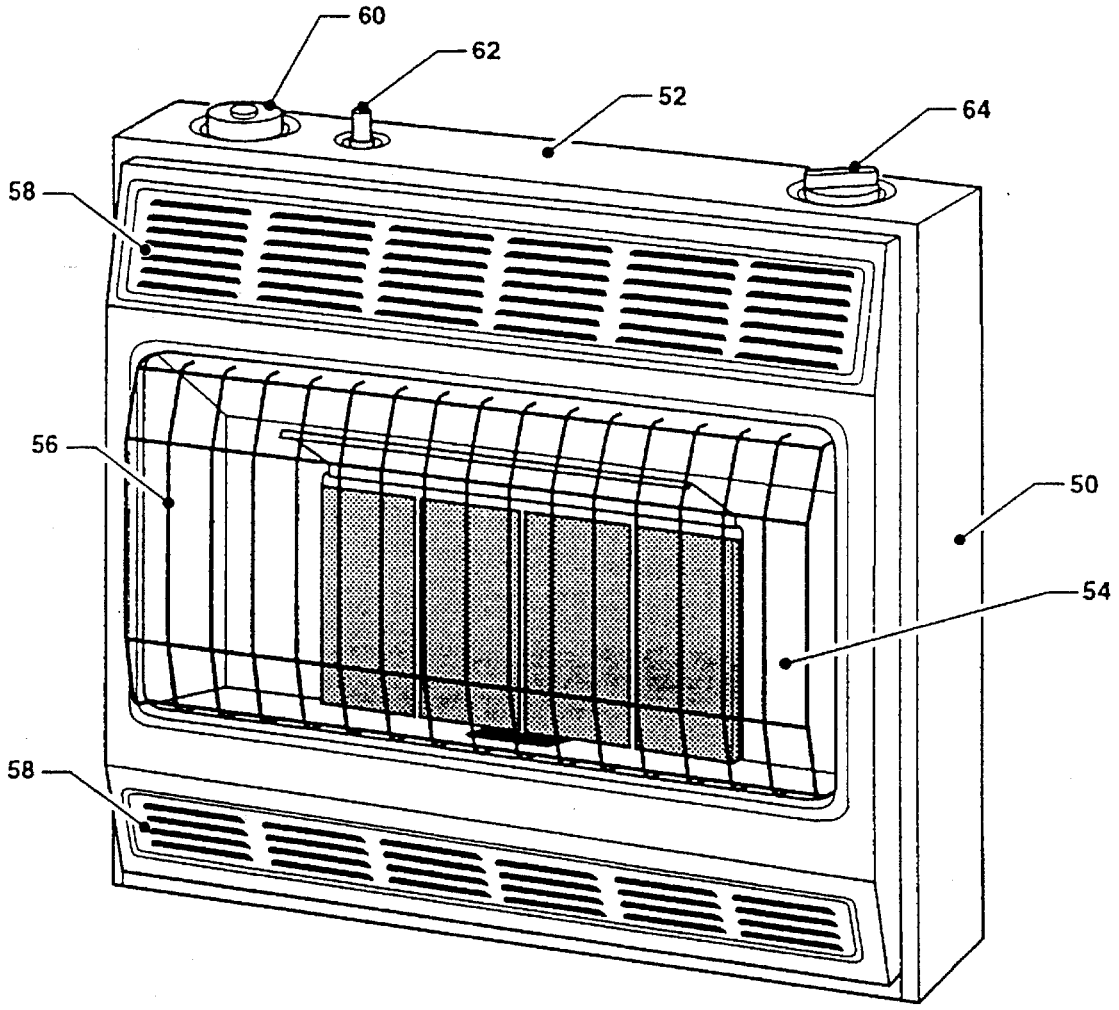
FIG. 2 is a perspective view of the heater of the present invention.

The preferred embodiment of the present invention is depicted in a residential unvented gas heater, including a housing 50 in FIG. 2. The housing 50 has a top surface 52, a heating chamber 54 containing ceramic infrared burner plaques A, B, C and D and a grill 56 to prevent accidental exposure to the burner plaques. The housing 50 also has vents 58 for air circulation. In the embodiment shown for purposes of illustrating, the heater contains four burner plaques. However, it will be understood that the invention is applicable to any desired number of burner plaques and to other types of infrared burners.

Figure 3:
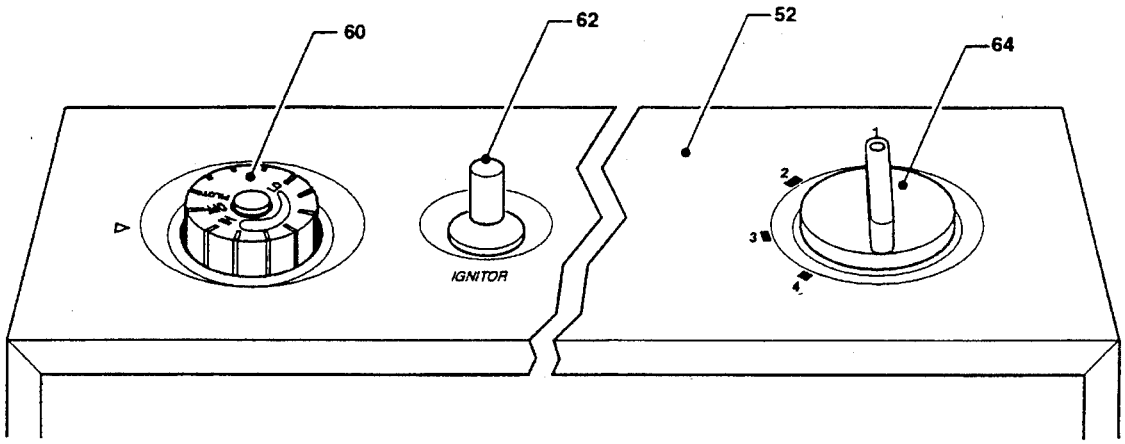
FIG. 3 is a broken away top view of the heater of FIG. 2.
Figure 4:
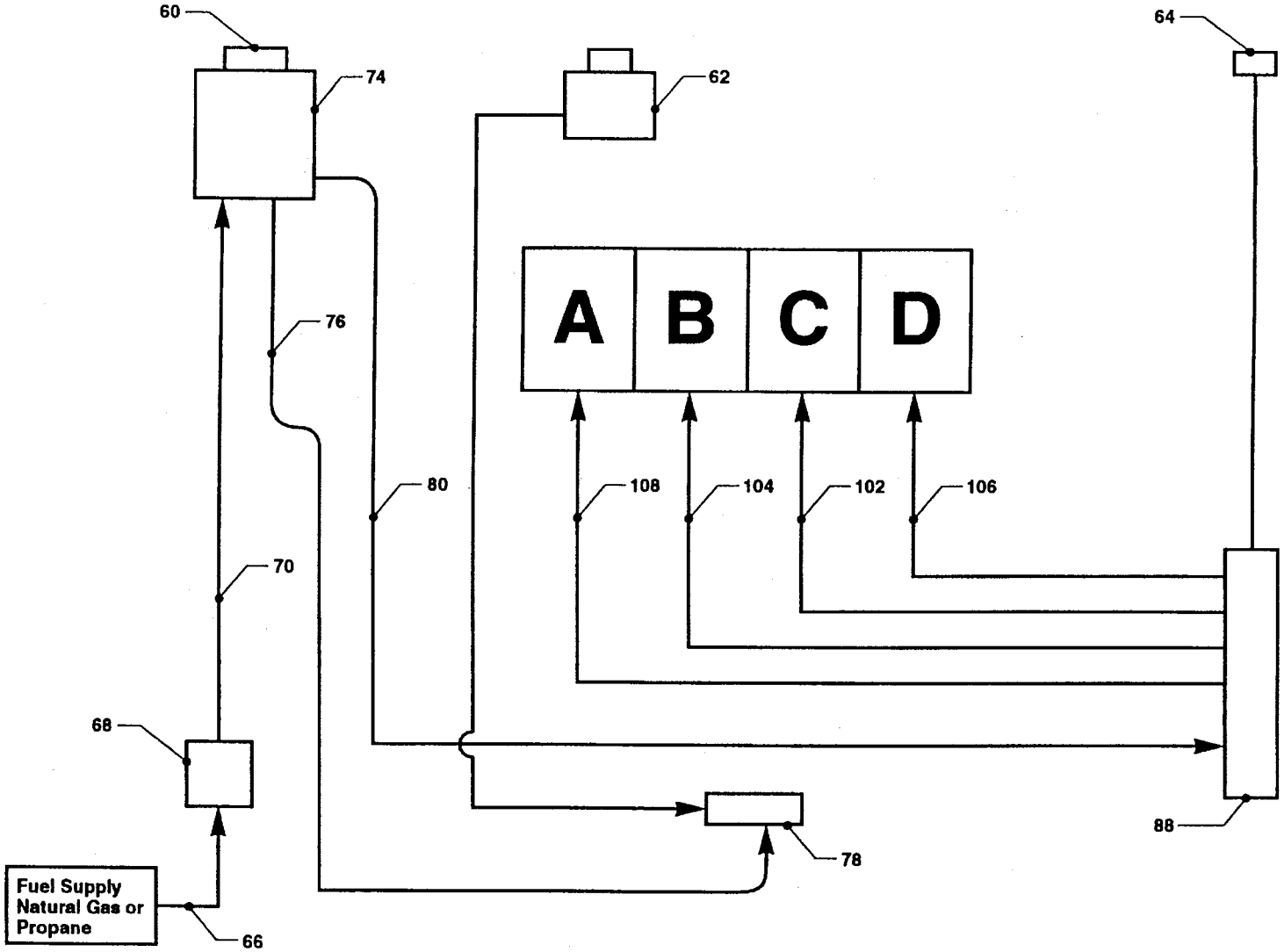
FIG. 4 is a schematic of the present invention.

The heater is controlled at the top 52 of the casing 50 which is best shown in FIG. 3. The top 52 contains a control knob 60, an ignitor 62 and an infrared burner selection knob 64. The assembly and operation of the present invention is described with reference to FIG. 4.

In the present invention, a fuel supply of natural gas or propane gas feeds through a conduit 66 into a main regulator 68, which feeds the gas through a conduit 70 to a thermostat and safety control valve 74. The control knob 60 operates the thermostat and safety control valve 74 with a variety of settings including "OFF," "PILOT," "LO" and "HI," as depicted in FIG. 3.

While the knob 60 is in the "OFF" position, no gas is admitted beyond valve 74, so the heater is in the off mode. To place the heater in pilot mode, the knob 60 is adjusted to the "PILOT" position. While in the pilot mode, valve 74 only admits gas through a conduit 76 to the pilot light system 78. The ignitor 62 is depressed and the gas admitted to the pilot light system 78 burns in a pilot flame. The pilot light system 78 is an oxygen depletion sensor that will shut-off the flow of gas from the safety control valve 74 if the oxygen level decreases very much below the normal oxygen level of about 21%.

The burners A, B, C or D radiate heat only when the thermostat calls for more heat. The thermostat mode is obtained by turning the knob 60 to "LO", "HI" or any position therebetween, corresponding to the desired heat setting. When knob 60 is turned to the thermostat mode, the thermostat and safety control valve 74 mechanically regulate the flow of gas which is admitted through a conduit 80 to the burner control valve, and eventually to burners A, B, C or D.

Figure 5:
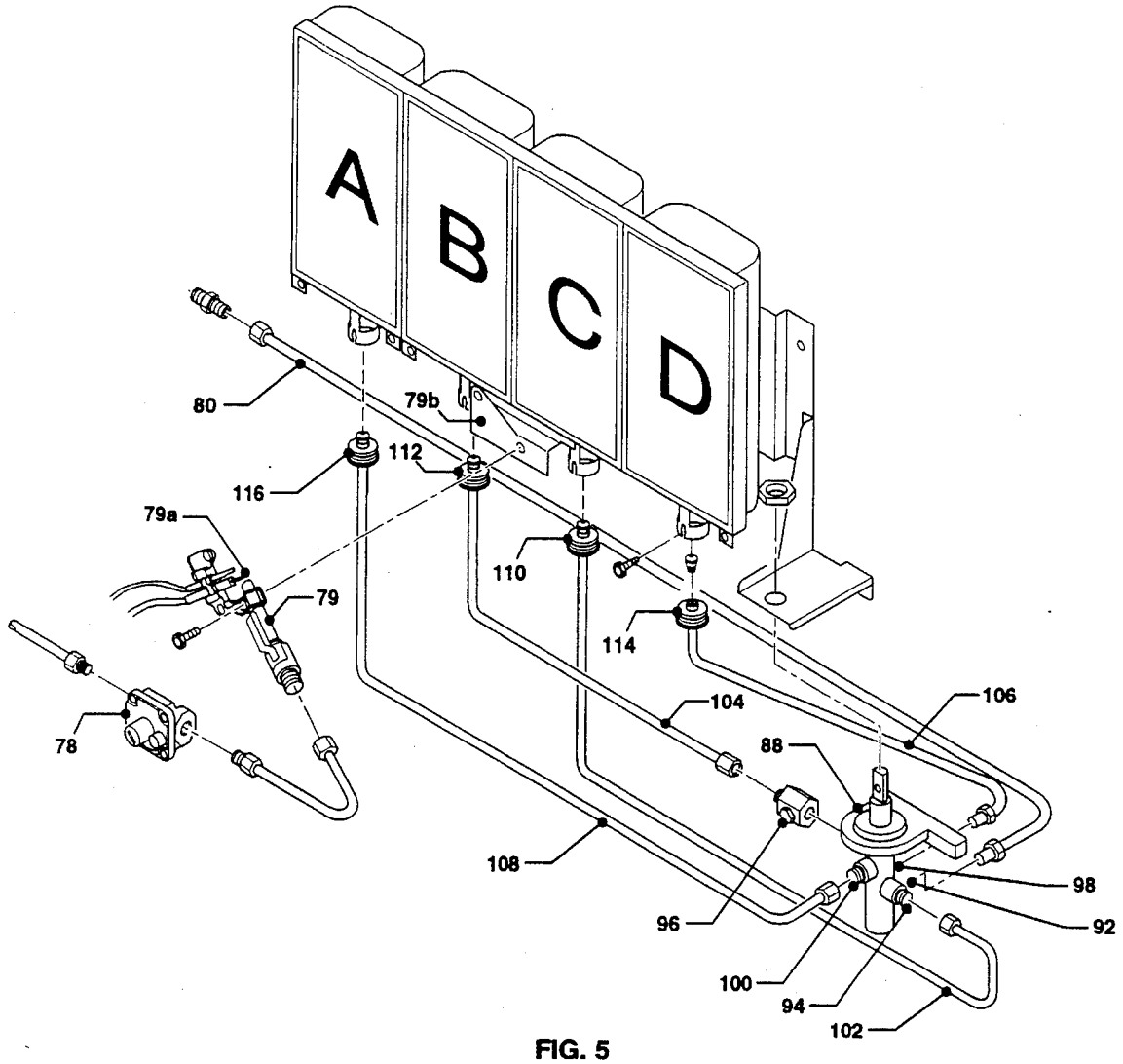
FIG. 5 is an exploded view of the heating assembly of the present invention.

As noted in FIG. 5, the pilot light system 78 includes a pilot tube 79 having its outlet adjacent the ignitor electrode 79*a*. The pilot light system is suitably mounted to a bracket 79*b* which is in turn mounted to the frame supporting the burners A, B, C and D. This mounting is such that the pilot flame is disposed at the juncture of the burners B and C. Thus, the pilot light system 78 ignites the gas supplied to burners B and C; burner B ignites the gas supplied to burner A; and burner C ignites the gas supplied to burner D.

The thermostat and safety control valve 74 may be of the type containing a bellows which moves between a fully open position and a fully closed position where it abuts against a duct wall to prevent gas passage. A temperature sensing element in communication with the bellows contains a liquid of low thermoconductivity. As the ambient temperature increases, the liquid expands into the bellows in the valve 74. As the bellows expands it abuts the duct wall and gas flow is terminated between the bellows and the duct wall, and thus to conduit 80 and the infrared burner control valve 88.

An initial distance between the bellows and the duct wall is adjustable by turning the control knob 60. The higher the setting, the greater the initial distance. Accordingly, a higher temperature is required to expand the bellows to overcome the distance and abut the duct wall to terminate gas flow. The lower the setting, the shorter the initial distance, and a lower temperature is required to expand the bellows to abut the duct wall.

When the bellows abuts the duct wall, the valve 74 reverts to pilot mode, so that gas is supplied only to the pilot light system 78. The thermostat and safety control valve 74 is preferably a model 630 Eurosit manufactured by S.I.T. Controls U.S.A., Inc. The valve 74 is identified by DESA International, Inc. as Part No. 098522-05. However, it will be understood that other similar valves may be applicable to the invention.

An infrared burner selection knob 64 connects to the valve 88 for mechanically controlling how many infrared burners A, B, C and D receive gas. The knob 64 moves between four settings, "1," "2," "3" and "4" as depicted in FIG. 3. The configuration of valve 88 is best shown in FIG. 5.

Figure 6:
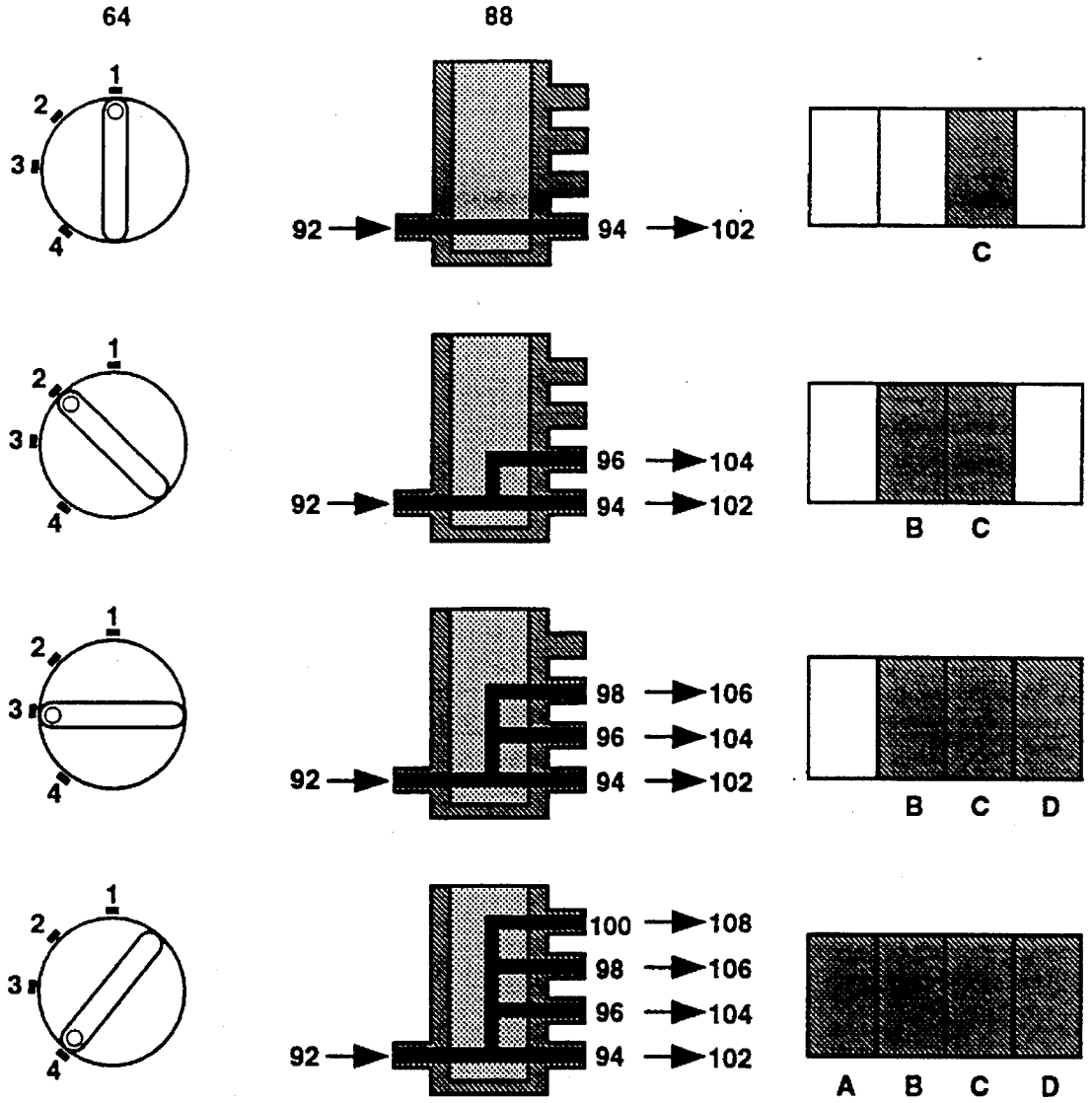
FIG. 6 is a schematic diagram which shows the control knob settings and respective port communication and plaque activity.

Referring to the schematic of FIG. 6, the valve 88 has an inlet port 92 and four outlet ports, 94, 96, 98 and 100 which are communicable with conduits 102, 104, 106 and 108, respectively. These conduits extend to respective burners as shown in FIG. 5 While the knob 64 is at setting "1," the valve 88 communicates inlet port 92 with outlet port 94 only, to admit gas through conduit 102. Conduit 102 disperses gas at an outlet 110 in the vicinity of burner C. The pilot system 78 ignites the gas so that it burns adjacent burner C which then radiates the heat.

While the knob 64 is at setting "2," the valve 88 communicates inlet 92 with outlet ports 94 and 96 to admit equivalent portions of gas through conduits 102 and 104, respectively. Conduit 104 disperses gas at an outlet 112 in the vicinity of burner B. Pilot system 78 ignites the gas dispersed from both conduits 102 and 104 adjacent burners C and B, respectively, which radiate heat.

While the knob 64 is at setting "3," the valve 88 communicates inlet 92 with outlet ports 94, 96 and 98 to admit equivalent portions of gas through conduits 102, 104 and 106, respectively. Conduit 106 disperses gas at outlet 114 in the vicinity of burner D. Pilot system 78 ignites the gas dispersed from conduits 102 and 104 adjacent burners C and B, respectively, which radiate heat. Burner C ignites the gas dispersed from conduit 106 adjacent burner D, which radiates heat.

Lastly, while the knob 88 is at setting "4," the valve 88 communicates inlet 92 with outlet ports 94, 96, 98 and 100 to admit equivalent portions of gas through conduits 102, 104, 106 and 108, respectively. Conduit 108 disperses gas at outlet 116 in the vicinity of burner A. Pilot system 78 ignites the gas dispersed from conduits 102 and 104 adjacent burners C and B, respectively; burner C ignites the gas dispersed from conduit 106 adjacent burner D; and burner B ignites the gas dispersed from conduit 108 adjacent burner A; thus, all burners radiate heat. These burner selections are all depicted in FIG. 6.

Irrespective of the number of active burners, all active burners receive equivalent amounts of the gas admitted from the thermostat and safety control valve 74. Consequently, the user of the present invention makes two separate selections when adjusting the heat output of the heater. First, the user selects a desired temperature setting between high and low. Second, the user selects how many burners contribute to achieve that desired temperature setting. The heater will cycle or modulate between pilot and the selected number of burners. By reason of this feature, the heater can provide heat in an efficient manner to a wide variety of rooms of different sizes and heat requirements.

Moreover, the user makes these selections regardless of whether electrical power is available to the heater. Both the temperature selection and the burner selection are performed mechanically, so that an energy source other than for gaseous fuel is not necessary to run the heater.

The present invention has been described in detail with particular reference to a preferred embodiment thereof. However, variations and modifications can be effected within the spirit and scope of the invention as described hereinabove and as set forth in the claims.

I claim:

1. A gas heater comprising:

(a) at least four independently operable heating elements with each heating element adjoining at least one other heating element;

(b) manually operable control means connected to each of said heating elements for activating a preselected number of said heating elements, said number being selected from any natural number ranging from one through the total number of heating elements in said plurality;

(c) thermostatically operable valve means connected to said manually operable control means and serving as the sole means for supplying gas to said preselected number of said heating elements as determined by operation of said manually operable control means, whereby said preselected number of heating elements may be modulated between off and a desired heat setting; and (d) a pilot light system mounted in the vicinity of said heating elements such that the pilot flame is disposed at the juncture of two of said heating elements, whereby gas admitted adjacent each one of said two heating elements will be ignited directly by said pilot light system and gas admitted adjacent the other of said heating elements will be ignited by the gas burning adjacent the surface of an adjoining heating element.

2. The gas heater according to claim 1, wherein each of said heating elements is an infrared burner.

3. The gas heater according to claim 1, wherein said thermostatically operable valve means has a non-electrically operated temperature sensitive operating element.

4. A gas heater comprising:

(a) a plurality of independently operable heating elements;

(b) control valve means having an inlet port and a plurality of outlet ports equal in number to or less than the total number of said heating elements, said control valve means including a movable member for communicating said inlet port with a preselected number of said outlet ports, said preselected number being selected from any natural number ranging from one through the total number of heating elements;

(c) a manual control member for operating said movable member;

(d) a plurality of conduits, each having an inlet end in communication with respective ones of said outlet ports and an outlet end disposed in the vicinity of respective ones of said heating elements;

(e) thermostatically operated valve means having a control element, an inlet opening and an outlet opening, said inlet opening being adapted to receive gas from a gas supply, said valve means having a non-electrically operated temperature sensitive operating element; and (f) a supply conduit communicating said outlet opening with said inlet port, said supply conduit serving as the sole means for supplying gas to said control valve means, whereby said thermostatically operated valve means, in response to a preselected setting of said control element, will regulate gas flow to said preselected number of said heating elements between off and a desired heat setting as determined by the position of said manual control member.

5. The gas heater according to claim 4 wherein the number of said outlet ports is equal to the number of said heating elements.

6. The gas heater according to claim 4, wherein each of said heating elements is an infrared burner.

7. A gas heater comprising:

(a) at least four independently operable heating elements, each heating element adjoining at least one other heating element;

(b) control valve means having an inlet port and a plurality of outlet ports equal in number to or less than the total number of said heating elements, said control valve means including a movable member for communicating said inlet port with a preselected number of said outlet ports, said preselected number being selected from any natural number ranging from one through the total number of heating elements;

(c) a manual control member for operating said movable member;

(d) a plurality of conduits, each having an inlet end in communication with respective ones of said outlet ports and an outlet end disposed in the vicinity of respective ones of said heating elements;

(e) thermostatically operated valve means having a control element, an inlet opening and an outlet opening, said inlet opening being adapted to receive gas from a gas supply;

(f) a supply conduit communicating said outlet opening with said inlet port, said supply conduit serving as the sole means for supplying gas to said control valve means, whereby said thermostatically operated valve means, in response to a preselected setting of said control element, will regulate gas flow to said preselected number of said heating elements between off and a desired heat setting as determined by the position of said manual control member; and (g) a pilot light system mounted in the vicinity of said heating elements such that the pilot flame is disposed at the juncture of two of said heating elements, whereby gas admitted adjacent each one of said two heating elements will be ignited directly by said pilot light system and gas admitted adjacent the other of said heating elements will be ignited by the gas burning adjacent the surface of an adjoining heating element.

* * * * *